United States Patent [19]

Kito

[11] 4,117,803

[45] Oct. 3, 1978

[54] DEVELOPER FLOW REGULATOR FOR A MAGNETIC BRUSH DEVELOPING DEVICE

[75] Inventor: Hidetoshi Kito, Ebina, Japan

[73] Assignee: Rank Xerox, Ltd., London, England

[21] Appl. No.: 793,456

[22] Filed: May 3, 1977

[30] Foreign Application Priority Data

May 17, 1976 [JP] Japan ..... 51-055438

[51] Int. Cl.[2] ..... G03G 15/09

[52] U.S. Cl. ..... 118/658

[58] Field of Search ..... 118/656, 657, 658, 661

[56] References Cited

U.S. PATENT DOCUMENTS

| | | | |
|---|---|---|---|
| 3,570,453 | 3/1971 | Nuzum | 118/657 |
| 3,906,897 | 9/1975 | Davidson | 118/658 X |
| 3,948,217 | 4/1976 | Forward | 118/658 |
| 4,040,387 | 8/1977 | Washio et al. | 118/658 |

*Primary Examiner*—Werner H. Schroeder

*Assistant Examiner*—Andrew M. Falik

[57] ABSTRACT

A magnetic brush developing arrangement including a roll for delivering developer to an electrostatic latent image-bearing surface and a regulating plate movable towards and away from the roll as a function of the clearance between the roll and the image bearing surface.

4 Claims, 3 Drawing Figures

FIG. 1
PRIOR ART
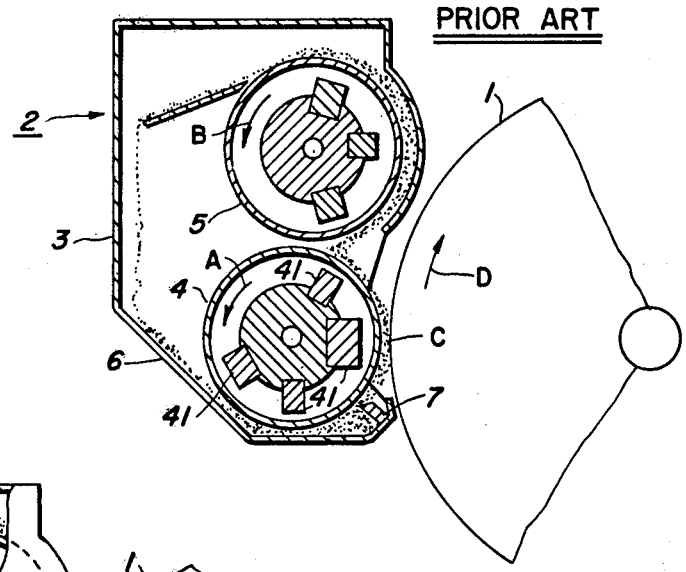
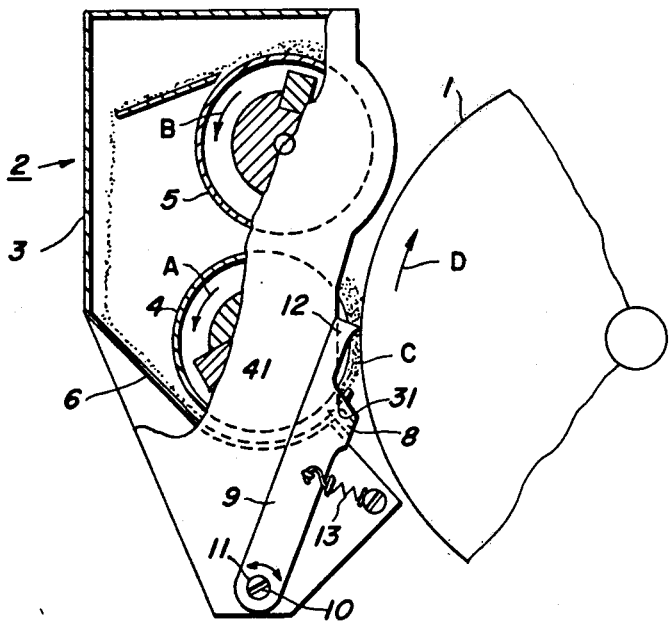
FIG. 2
FIG. 3
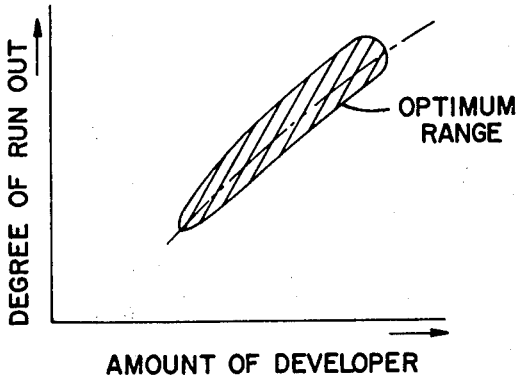

DEVELOPER FLOW REGULATOR FOR A MAGNETIC BRUSH DEVELOPING DEVICE

BACKGROUND OF THE INVENTION

This invention relates to a magnetic brush developing device for electrostatographic apparatus.

In known magnetic brush developing devices, it is common to develop an electrostatic latent image formed on a rotating or moving electrostatic imagebearing member in the form of a belt, sheet, or cylinder, by applying developing material to the image-bearing member. In magnetic brush developing arrangements, developer material is formed into a brush-like configuration on a non-magnetic, rotating, developing roll inside which are located magnetic field defining members. During development, the outer surface of the belt-like or cylindrically shaped electrostatic image-bearing member approaches or separates from the developing roll due to irregularity of its rotation radius or surface irregularities. This will be hereinafter referred to simply as "run-out" phenomenon and is characterized by a varying rather than constant spacing between the developing roll and the image bearing member during the development process.

Referring to FIG. 1 there is shown a known magnetic brush developing device in which an electrostatic image-bearing member 1 (in the form of a photosensitive drum) rotates in the direction of the arrow D. A magnetic brush developing device 2 is arranged in a suitable position around the electrostatic image-bearing member 1 and includes a housing or enclosure 3 having therein a developing roll 4 and a feed roll 5 rotating in the directions of arrows A and B, respectively. The developer 6 provided at the bottom or sump portion of the enclosure 3 is transferred to a developing zone C by the rotation and magnetic force of the developing roll 4 having therein a magnetic field developing means in the form of stationary magnets 41. An electrostatic latent image is formed on the photosensitive drum surface by well known charging and exposure steps (not shown) of the electrophotographic reproduction process and presented for development at the developing position C. A developer discharge-regulating plate or trimmer bar 7 is usually provided to control the amount of developer material 6 passing from the developer housing to the developing zone C via the roll 4. The trimmer bar usually extends across the width of the development enclosure 3 parallel to and spaced from the roll 4 in an area upstream of or adjacent the area of closest proximity between the roll 4 and surface 1. The clearance between the bar 7 and the roll 4 is preset and fixed to provide a preselected height of developer material reaching the development zone C.

However, the developing conditions including the clearance between the photosensitive drum 1 and the developing roll 4 invariably change or vary due to the run-out phenomenon and it is thus difficult to achieve an image with a constant image density. In addition, when the magnetic brush developing device is disassembled from the duplicating machine for maintenance of the device or upon occurrence of a problem, and later reassembled, the developing conditions which had been optimally adjusted are undesirably changed. The developed image which is produced under such conditions will be changed in image density or will be stained at background portions, it being difficult to obtain stable images of good quality.

In order to overcome the above difficulty, there has been proposed a magnetic brush developing device in which the clearance between the photosensitive drum 1 and the developing roll 4 is maintained constant by moving the magnetic brush developing roll in accordance with the "run-out" of the photosensitive drum 1. An arrangement of this general type is disclosed in U.S. Pat. No. 3,948,217. However, the magnetic brush developing device of the above-mentioned type has the disadvantage that it requires the quick movement of one or more magnetic brush rolls of significant weight and volume. In addition, the electrostatic latent image on the photosensitive drum 1 is adversely influenced due to vibrations of the developing device, since the photosensitive drum 1 is indirectly carried from the same mounting frame as magnetic brush developing device.

OBJECTS AND SUMMARY OF THE INVENTION

It is accordingly an object of the present invention to provide a magnetic brush developing device in which the amount of a developer on a developing roll can be arbitrarily changed depending on the degree of the run-out of an electrostatic image-baring member so that optimum developing conditions can be invariably maintained.

BRIEF DESCRIPTION OF THE DRAWINGS

FIG. 1 is a schematical view, partly in section, of a known magnetic brush developing device;

FIG. 2 is a schematic and sectional view of a magnetic brush developing device according to the invention; and FIG. 3 is a graphical representation of the amount of developer need to provide optimum developability as a function of the degree of run-out.

DESCRIPTION OF THE PREFERRED EMBODIMENT

The present invention will be particularly described with reference to FIG. 2 which shows a magnetic brush developing device according to the invention and wherein the same reference numerals as used in FIG. 1 have been employed to identify functionally similar elements. The amount of the developer 6 which is transferred to the developing roll 4 is suitably controlled in the arrangement of FIG. 2 by a movable developer discharge-regulating plate or trimmer bar 8. The developer discharge-regulating plate 8 is supported jointly by and between a pair of support arms 9 (only one shown) located exterior to and adjacent both sides of the developer housing 3.

The arms 9 are secured to the side walls of the developer housing (only one shown) by means of any suitable fastener, such as the screw 11, for pivotal movement about an axis 10 parallel to the axis of the roll 4. The plate 8 extends through a complementarily shaped slot 31 in the lower portion of the developer housing 3 for movement toward and away from the roll 4 in accordance with the pivotal movement of the arms 9.

The ends of the arms 9 opposite the screw 11 are provided with a follower configuration 12 and are continuously urged or biased into contact with the margins of the drum 1 outside the area used in the xerographic process by means of springs 13 (only one shown). One end of the spring 13 is connected to the housing 3 by means of a fastener while the other end is suitably coupled to the mid-portions of the arms 9.

With the developer regulating plate 8 arranged as described above, it moves toward or away from the outer surface of the developing roll 4 as a function of the run-out of the photosensitive drum 1. This results in a variation of the amount of the developer 6 reaching the development zone C in accordance with the degree of the run-out. This makes it possible to optimally maintain the height or thickness (and depositing amount) of the developer 6 to be contacted with the photosensitive drum 1.

FIG. 3 is a graph which indicates in a general manner the thickness or height of the developer on the roll 4 which is required to maintain optimum developing conditions as a function of changes in the degree of run-out of the photosensitive drum 1. It is seen from FIG. 3 that as the degree of run-out increases the amount of developer required increased substantially linearly. The cross hatched area of FIG. 3 indicates the allowable range or window within which the amount of developer material may vary while still maintaining acceptable results from the development system. It should be clear to one skilled in the art that FIG. 3 is of necessity general in nature since the specific amount of developer required to be delivered varies greatly dependent on the parameters of the system such as the developer material, the nature and velocity of the photoreceptor surface, etc.

During operation of the magnetic brush according to the invention, when the degree of the runout increases to thereby increase the clearance between the photosensitive drum 1 and the developing roll 4, the support arms 9 pivot toward the photosensitive drum in the clockwise direction (as viewed in FIG. 2) by the action of the spring 13. As a result, the developer amount-regulating plate 8 fixedly supported on the support members 9 also turns in the clockwise direction and thus separates from the developing roll 4, increasing the amount of the developer 6 being delivered to the development zone C.

In contrast, when the clearance between the photosensitive drum 1 and the developing roll 4 decreases with a decrease of the degree of run-out, the support members 9 pivot in a counterclockwise direction, so that the regulating plate 8 fixed on the support member 9 also moves in the counterclockwise direction and approaches the developing roll 4, decreasing the depositing amount of the developer 6 reaching the development zone C. Thus, the depositing amount or thickness of the developer 6 changes proportionally to the degree of the run-out, as shown generally by the solid line of FIG. 3.

Thus, the amount of the developer can be suitably changed by a change in run-out of the electrostatic image-bearing member 1, ensuring optimum developing conditions. Accordingly, there can be obtained a reproduced image which is more constant in image density, almost free from contamination in background areas, and stable and excellent in image quality.

The magnetic brush developing device of the invention is simple in construction, easy to maintain, dependable and inexpensive. In addition, since only a small-sized developer regulating plate is required, easy modification or retrofit into known developing arrangements is facilitated.

After detachment and retachment of an entire magnetic brush housing, a stable and excellent image reproduction can be readily produced since the amount of the developer 6 can be optimally set in accordance with the clearance between the electrostatic imagebearing member 1 and the developing roll 4.

What is claimed is:

1. In a magnetic brush developing device for developing an electrostatic image on an electrostatic latent image bearing member with developer formed into a brush-like configuration on a developing roll the improvement comprising a developer discharge-regulating plate for regulating the amount of the developer on said developing roll as a function of the clearance between said roll and said member wherein said plate is carried by a pair of arms, said arms are mounted for pivotal movement toward and away from said roll in response to the distance between said roll and said surface.

2. The combination recited in claim 1 wherein said roll is mounted within a developer housing, said plate is mounted on a pair of arms, each of said arms being pivotally mounted adjacent one end thereof from said housing for rotation about an axis parallel to the axis of said roll, the other ends of said arms being biased into continuous contact with said member, said plate being carried on said arms intermediate said ends thereof, whereby changes in the clearance between said roll and said member result in movement of said plate toward and away from said roll.

3. The combination recited in claim 2 wherein said arms are located exterior of said housing.

4. The combination recited in claim 2 wherein said plate extends through a slot in said housing.

* * * * *